US012123111B2

(12) United States Patent
Nie et al.

(10) Patent No.: US 12,123,111 B2
(45) Date of Patent: Oct. 22, 2024

(54) LIFTING SYSTEM FOR INNER YARN RAILS

(71) Applicant: YICHANG JINGWEI TEXTILE MACHINERY CO., LTD., Hubei (CN)

(72) Inventors: Jian Nie, Hubei (CN); Pihua Zhang, Hubei (CN); Ming Zhang, Hubei (CN); Yanwei Zhang, Hubei (CN); Lei Wu, Hubei (CN); Yuchao Yan, Hubei (CN); Yongming Li, Hubei (CN); Longfei Zhang, Hubei (CN); Qingqing Lv, Hubei (CN); Huanian Yang, Hubei (CN)

(73) Assignee: YICHANG JINGWEI TEXTILE MACHINERY CO., LTD. (CN)

( * ) Notice: Subject to any disclaimer, the term of this patent is extended or adjusted under 35 U.S.C. 154(b) by 90 days.

(21) Appl. No.: 18/086,226

(22) Filed: Dec. 21, 2022

(65) Prior Publication Data

US 2024/0125011 A1 Apr. 18, 2024

(30) Foreign Application Priority Data

Oct. 13, 2022 (CN) ..... 202211251288.0

(51) Int. Cl.
*D01H 9/18* (2006.01)
*B65H 67/06* (2006.01)

(52) U.S. Cl.
CPC ..... *D01H 9/182* (2013.01); *B65H 67/066* (2013.01); *B65H 67/067* (2013.01);
(Continued)

(58) Field of Classification Search
CPC ..... D01H 9/182; D01H 9/18; D01H 9/187; D01H 9/185; D01H 9/005; D01H 9/006;
(Continued)

(56) References Cited

U.S. PATENT DOCUMENTS 3,788,054 A * 1/1974 Haussmann ..... D01H 9/18 198/577
3,946,547 A * 3/1976 Salmoiraghi ..... D01H 9/182 57/274

(Continued)

FOREIGN PATENT DOCUMENTS

CN 212270321 U * 1/2021
CN 217378135 * 9/2022

(Continued)

OTHER PUBLICATIONS

English translation of CN217378135U, obtained via espacenet.com (last accessed May 2, 2024). (Year: 2024).*

*Primary Examiner* — Patrick J. Lynch

(57) ABSTRACT

A lifting system for inner yarn rails is provided. The system includes an in-air conveying rail, and a carrier unit, wherein the in-air conveying rail is configured to convey the carrier unit, and the carrier unit is configured to carry a winding package; an inner yarn-carrier-lifting section is arranged on the in-air conveying rail, the inner yarn-carrier-lifting section is positioned on both sides of a twisting machine; when the inner yarn-carrier-lifting section rises, it communicates with the in-air conveying rail; when the inner yarn-carrier-lifting section descends, it approaches the position of a spindle bucket of the twisting machine.

8 Claims, 6 Drawing Sheets

(52) U.S. Cl.
CPC ..... *B65H 2403/20* (2013.01); *B65H 2403/92* (2013.01); *B65H 2553/52* (2013.01); *B65H 2701/31* (2013.01)

(58) Field of Classification Search
CPC .... D01H 9/008; B65H 67/066; B65H 67/067; B65H 2301/41734
See application file for complete search history.

(56) References Cited

U.S. PATENT DOCUMENTS 4,023,339 A * 5/1977 Laderach ..... D01H 9/10 104/91
4,840,124 A * 6/1989 Tadashima ..... D01H 9/182 104/168
4,899,530 A * 2/1990 Morrison ..... D01H 9/18 57/274
4,979,360 A * 12/1990 Kallmann ..... D01H 9/18 57/276
5,136,833 A * 8/1992 Inger ..... D01H 9/16 242/476.1
5,239,814 A * 8/1993 Yamada ..... D01H 9/005 57/352
5,299,415 A * 4/1994 Wanger ..... D01H 13/28 57/308
5,359,846 A * 11/1994 Miyamoto ..... D01H 4/08 57/414
5,522,210 A * 6/1996 Mack ..... D01H 9/182 57/267
5,586,428 A * 12/1996 Asai ..... D01H 9/10 57/261
5,588,602 A * 12/1996 Uno ..... D01H 9/10 57/274
5,768,876 A * 6/1998 Messing ..... D01H 9/182 242/470
5,797,255 A * 8/1998 Saito ..... D01H 9/046 57/275
5,996,327 A * 12/1999 Mack ..... D01H 9/182 57/274

FOREIGN PATENT DOCUMENTS

DE 4312073 A1 * 10/1994 ..... D01H 9/182
DE 19616108 A1 * 10/1997 ..... D01H 9/04
DE 19917969 A1 * 10/2000 ..... D01H 4/50
JP 63295729 A * 12/1988 ..... D01H 9/18
JP 05287624 A * 11/1993 ..... B65H 67/064
JP H07846 B2 * 1/1995 ..... D01H 9/182

* cited by examiner

LIFTING SYSTEM FOR INNER YARN RAILS

CROSS-REFERENCE TO RELATED APPLICATION

This application claims priority from the Chinese patent application 202211251288.0 filed Oct. 13, 2022, the content of which is incorporated herein in the entirety by reference.

TECHNICAL FIELD

The present disclosure relates to the technical field of twisting and weaving equipment in factories, in particular to a lifting system for inner yarn rails.

BACKGROUND

Existing twisting and weaving factories make donning mainly in manual way, but due to long donning time, low efficiency and big labor intensity arising from their expansion in scale, this way has become an urgent problem for various enterprises. There is a technical solution on robotic donning with AGV (Automated Guided Vehicle) in the prior art, such as a China patent CN111996627A named an automatic donning for twisting machine, but the donning efficiency provided in this solution is still low; moreover, its control is difficult, and the robot has the weak ability to dodge operators, thus often cause many disruptions to the operator's work. There is also a technical solution on automatic donning and doffing, but this solution still needs to make manual donning after doffing, such as a China patent CN112011863A named an automatic doffing system for twisting production. Each yarn winding package used for industry weighs more than 10 kilograms, and each operator needs to perform donning several hundreds times every day, how to improve the automation level of donning and reduce the labor intensity of operators becomes a technical problem.

SUMMARY

The technical problem to be solved by the present disclosure consists in the reduction in the labor intensity of donning and the improvement of donning efficiency, therefor we provide a lifting system for inner yarn rails.

In order to solve the above technical problem, the technical scheme adopted in the present disclosure is as follows:

A lifting system for inner yarn rails, comprising an in-air conveying rail, the in-air conveying rail being configured to convey a carrier assembly, and the carrier assembly being configured to carry a winding package;

an inner yarn-rail-lifting section is arranged on the in-air conveying rail, the inner yarn-rail-lifting section is positioned on both sides of a twisting machine; when the inner yarn-rail-lifting section ascends, it communicates with the in-air conveying rail; when the inner yarn-rail-lifting section descends, it approaches the position of a spindle bucket of the twisting machine.

In a preferred embodiment, the carrier assembly is composed of a plurality of conveying units articulated with each other, and each conveying unit in the carrier assembly corresponds to a spindle position of the twisting machine.

In a preferred embodiment, the carrier assembly is structured in the relation that an articulating connection rod has a suspending wheel set suspending within in the in-air conveying rail, the articulating connection rod is configured to articulate and connect a plurality of the conveying units with each other, the bottom of the articulating connection rod is connected with a first carrier-connecting rod, the first carrier-connecting rod is connected with a four bar linkage, a draw spring is arranged between two connecting rods approached the four bar linkage at the bottom, the two connecting rods approached by the four bar linkage at the bottom are connected with a first suspending rod and a second suspending rod, respectively, and barbs are arranged on the bottoms of the first suspending rod and the second suspending rod;

the draw spring is configured to direct the first suspending rod and the second suspending rod to part from each other.

In a preferred embodiment, the carrier assembly is structured in the relation that an articulating connection rod has a suspending wheel set suspending within in the in-air conveying rail, the articulating connection rod is configured to articulate and connect a plurality of the conveying units with each other, the bottom of the articulating connection rod is connected with a second carrier-connecting rod, the bottom of the second carrier-connecting rod is connected with a hugging arm, a space for loading an inner yarn winding package is arranged in the middle of the hugging arm, and an opening is arranged at the bottom of the hugging arm.

In a preferred embodiment, a supporting frame is arranged on the both sides of the twisting machine, the inner yarn-rail-lifting section is slidingly connected with the supporting frame, a lifting device for inner yarn rails is arranged on the supporting frame, the lifting device for inner yarn rails is connected with the inner yarn-rail-lifting section, and configured to drive the inner yarn-rail-lifting section to ascend and descend;

the lifting device for inner yarn rails is an air cylinder, a hydraulic cylinder or a gear rack drive mechanism.

In a preferred embodiment, a supporting frame is arranged on the both sides of the twisting machine, a lifting rail is vertically arranged on a stick of the supporting frame, a lifting pulley assembly is arranged inside the lifting rail, and the lifting pulley assembly is connected with the inner yarn-rail-lifting section by means of a connecting rod;

the supporting frame is provided with a plurality of rotary rotation shafts, which are arranged in the direction of the inner yarn-rail-lifting section, and the rotation shafts are connected to a driving device to drive the rotation shaft to rotate, a plurality of winding disks are arranged on the rotation shaft, each winding disk is wound with a suspending belt, the lower end of the suspending belt is connected to the inner yarn-rail-lifting section, and the rotation shaft rotates to drive the inner yarn-rail-lifting section to ascend and descend.

In a preferred embodiment, the driving device is a lifter driving motor, the lifter driving motor is connected to the rotation shaft by means of a transmission mechanism, and drives the rotation shaft to rotate;

the lifter driving motor, the transmission mechanism or the rotation shaft is provided with a diversion angle sensor.

In a preferred embodiment, a position sensor is arranged at the position where the in-air conveying rail is connected with the inner yarn-rail-lifting section, or at the position where the supporting frame is slidingly connected with the inner yarn-rail-lifting section, so as to detect whether the inner yarn-rail-lifting section is aligned with the in-air conveying rail.

In a preferred embodiment, at the position where the in-air conveying rail is connected with the inner yarn-rail-lifting section, the in-air conveying rail has an upper baffle arranged on the top of its end head, and side baffles arranged on its both sides, the upper baffle and the side baffle are out from the end head of the in-air conveying rail, and the inside of the bottom of the side baffle is provided with a bevel, which is fairly thin in the thickness near its bottom, and fairly thick in the thickness near its top.

In a preferred embodiment, a travel driving unit is arranged on the in-air conveying rail to drive the carrier assembly to travel;

the in-air conveying rail is provided with a carrier assembly sensor, which is configured to detect the position of the carrier assembly and the sort of the winding packages carried on the carrier assembly;

a diverging-and-merging switch is arranged on the in-air conveying rail, so as to switch different rails;

a sliding frame is arranged at the bottoms of the both sides of the twisting machine, and the spindle bucket is arranged on the sliding frame, which is used to slide the spindle bucket out from the twisting machine for donning.

In the lifting system for inner yarn rails according to the present disclosure, the carrier assembly is used to deliver the winding packages along the in-air conveying rails, and the winding packages delivered each time by one carrier assembly can correspond to each spindle position of the twisting machine, dramatically improving the delivery efficiency of the winding packages. Moreover, the structure of the inner yarn-rail-lifting section enables the winding packages to approach the spindle buckets, thereby dramatically reducing the labor intensity of operators. In a preferred solution, the bottom of the twisting machine is provided with a sliding frame, which is slid along with the spindle buckets to the outside of the twisting machine, so that the descended winding packages can fall directly into the spindle buckets, and further reduce the labor intensity of operators.

BRIEF DESCRIPTION OF THE DRAWINGS

We shall further describe the present disclosure in combination with the drawings and examples as follows.

Figure 1:
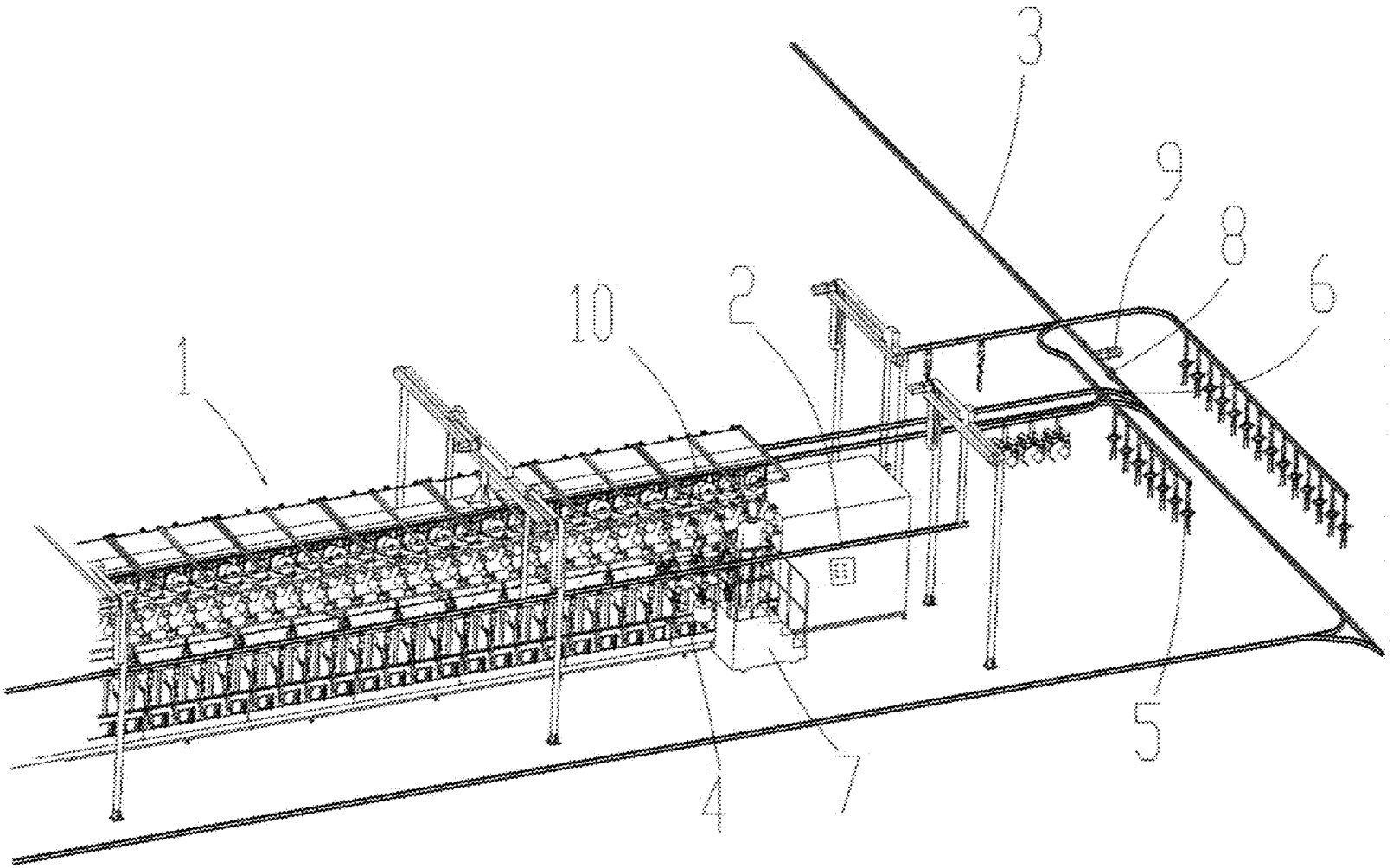
FIG. 1 is a 3D stereogram of the overall structure of the present disclosure.

Wherein: twisting machine 1, spindle position 101, lifting device for inner yarn rails 2, supporting frame 201, rotation shafts 202, winding disks 203, lifter driving motor 204, transmission mechanism 205, suspending belt 206, fixed base 207, connecting rod 208, upper baffle 209, side baffles 210, lifting rail 211, lifting pulley assembly 212, position sensor 213, stick 214, driving device 215, diversion angle sensor 216, bevel 217, in-air conveying rail 3, inner yarn-rail-lifting section 31, spindle bucket 4, carrier assembly 5, first carrier-connecting rod 51, four bar linkage 52, draw spring 53, first suspending rod 54, second suspending rod 55, suspending wheel set 56, articulating connection rod 57, hugging arm 58, second carrier-connecting rod 59, first connecting rod 501, second connecting rod 502, opening 503, diverging-and-merging switch 6, ascending trolley 7, carrier assembly sensor 8, travel driving unit 9, winding package 10, sliding frame 11.

DETAILED DESCRIPTION OF SOME EMBODIMENTS

Example 1

Figure 2:
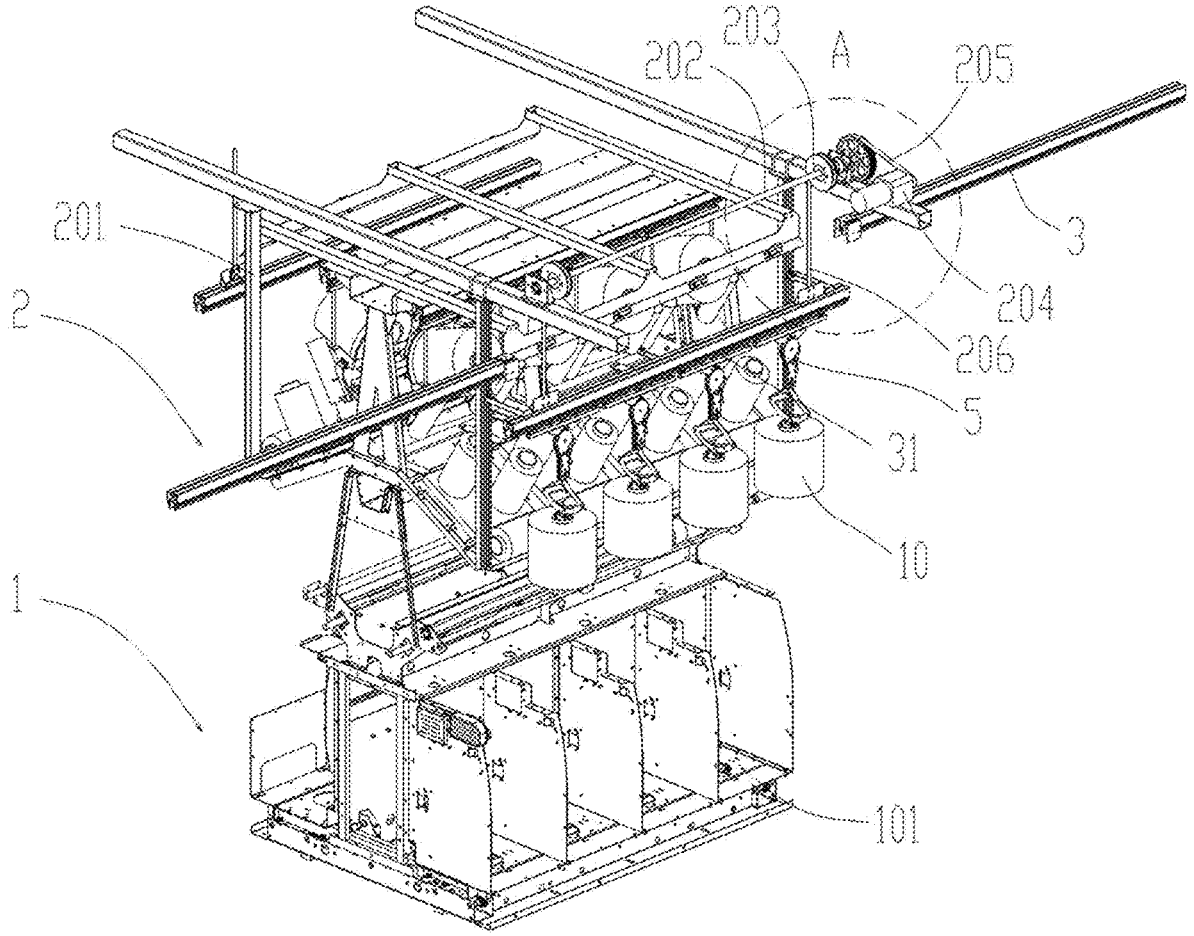
FIG. 2 is a 3D stereogram of the lifting system for inner yarn rails according to the present disclosure.
Figure 3:
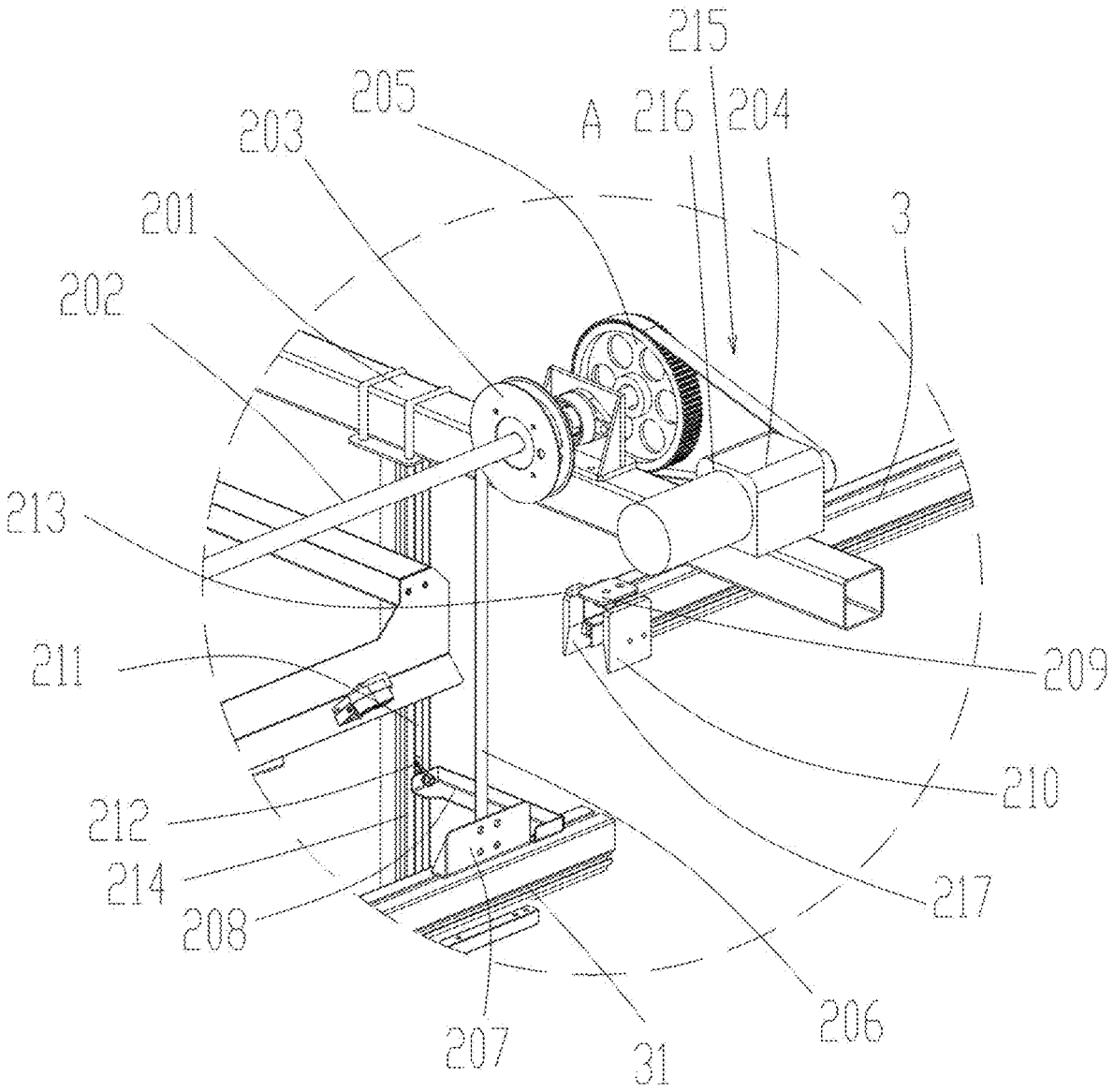
FIG. 3 shows a local view enlarged at A in FIG. 2.

As shown in FIGS. 1~3, the lifting system for inner yarn rails in a twisting and weaving factory includes the in-air conveying rail 3, which is used to convey the carrier assemblies 5, and the carrier assemblies 5 are used to carry the winding packages 10.

Figure 6:
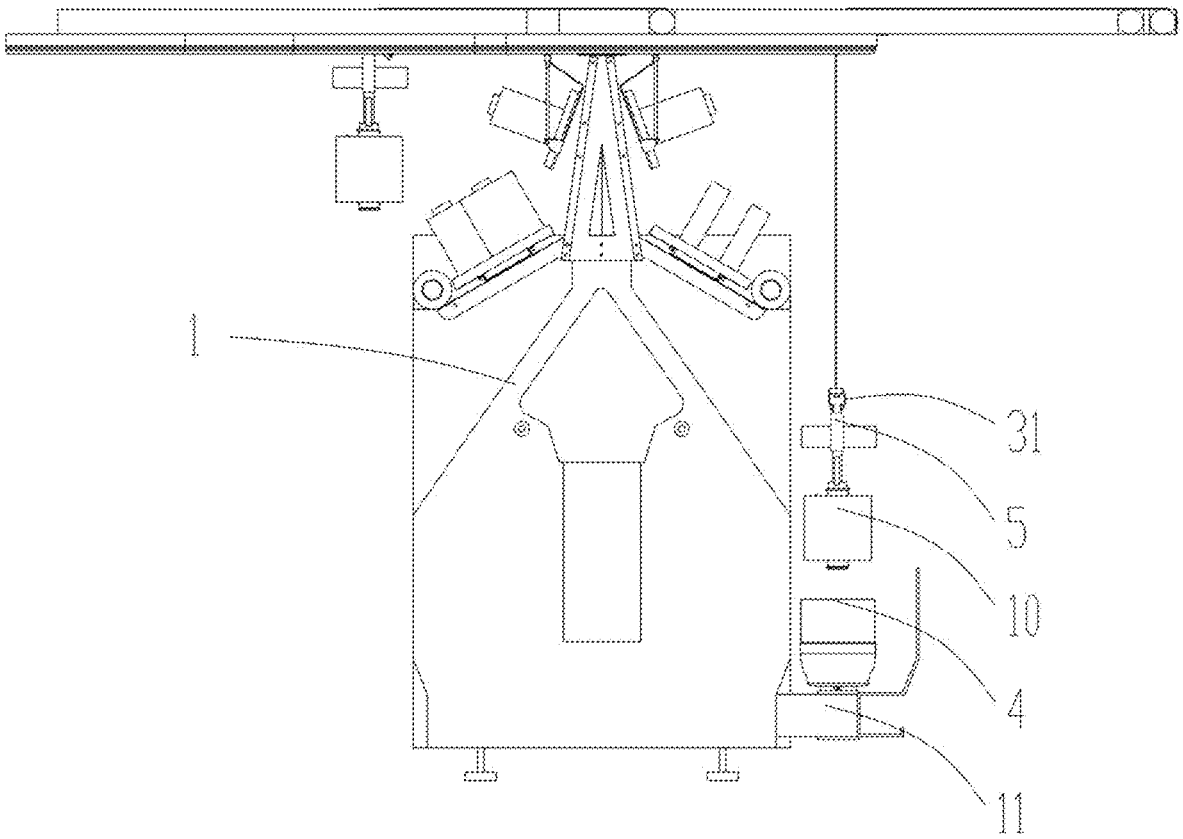
FIG. 6 is a structure diagram of the carrier assembly directly loading the winding packages into the spindle buckets according to the present disclosure.

The in-air conveying rail 3 is provided with the inner yarn-rail-lifting sections 31, which are positioned on both sides of the twisting machine 1; when the inner yarn-rail-lifting sections 31 rise, they communicate with the in-air conveying rail 3; when the inner yarn-rail-lifting sections 31 descend, they approach the position of the spindle buckets 4 of the twisting machine 1. This structure enables the carrier assemblies 5 loaded with the winding packages 10 to descend to the position close to the spindle buckets 4, even the winding packages 10 to directly enter the spindle buckets 4 as shown in FIG. 6.

Figure 5:
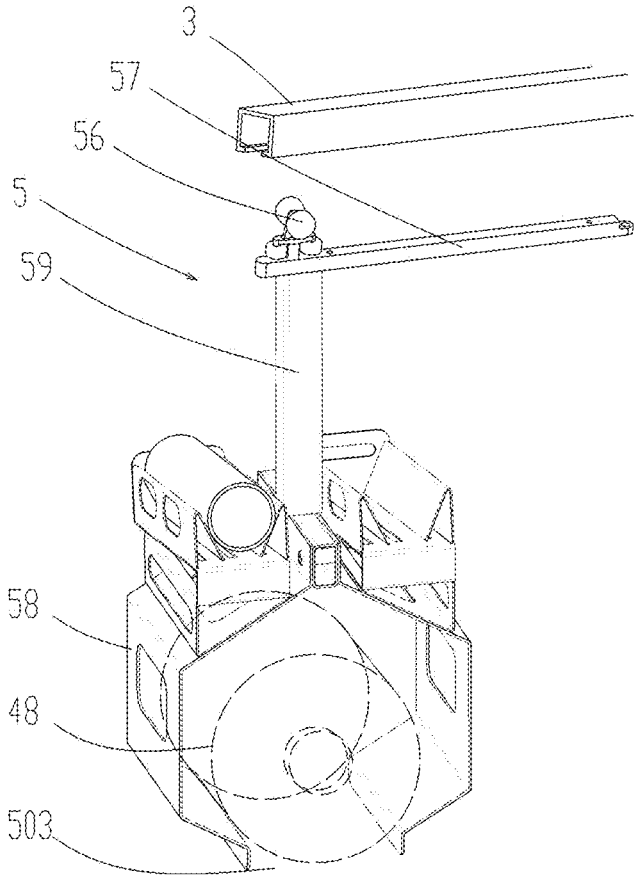
FIG. 5 is another optional structure diagram of the carrier assembly according to the present disclosure.

As a preferred solution shown in FIG. 5, the carrier assembly 5 is composed of a plurality of conveying units articulated with each other, and the conveying units within each carrier assembly 5 correspond to the spindle positions 101 of the twisting machine 1. That is, donning at all spindle positions 101 can be performed in one delivery, dramatically improving efficiency.

Figure 4:
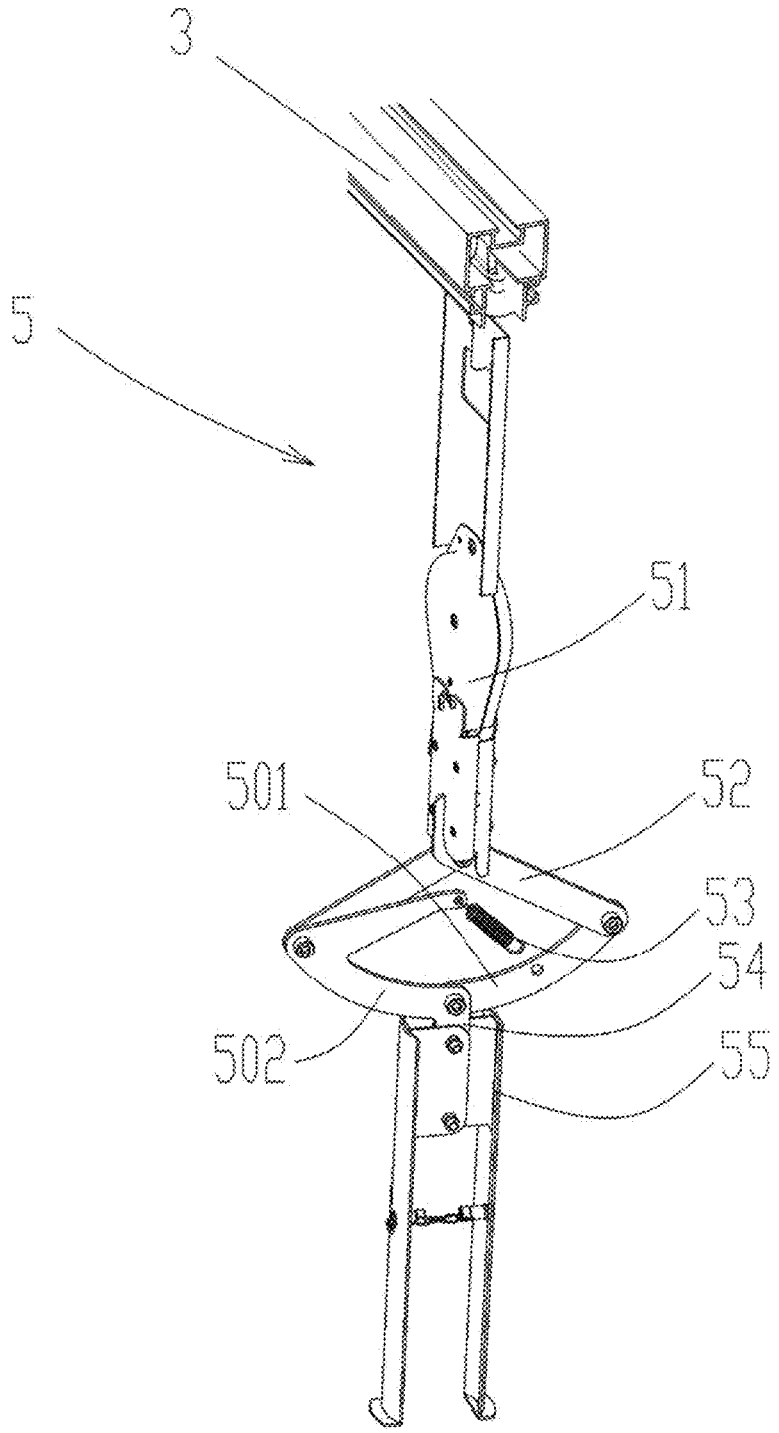
FIG. 4 is a structure diagram of the carrier assembly according to the present disclosure.

As a preferred solution shown in FIGS. 4 and 5, the carrier assembly 5 is structured such that the articulating connection rod 57 has a suspending wheel set 56 suspending within in the in-air conveying rail 3, the articulating connection rod 57 is used to articulate and connect a plurality of conveying units with each other, the bottom of the articulating connection rod 57 is connected with the first carrier-connecting rod 51, and the first carrier-connecting rod 51 is connected with the four bar linkage 52. The four bar linkage 52 approaches two connecting rods at the bottom, that is, the first connecting rod 501 and the second connecting rod 502, between which the draw spring 53 is arranged, the two connecting rods approached by the four bar linkage 52 at the bottom are connected with the first suspending rod 54 and the second suspending rod 55, respectively. Barbs are provided on the bottoms of the first suspending rod 54 and the second suspending rod 55, and the draw spring 53 is used to direct the first suspending rod 54 and the second suspending rod 55 to part from each other.

This structure enables the first suspending rod 54 and the second suspending rod 55 to extend into the bobbin of the winding package 10, so as to hook the bobbin and fix the winding package 10, and the four bar linkage 52 to be pinched at arrival of the carrier assembly 5 above the spindle bucket 4, so as to detach the first suspending rod 54 and the second suspending rod 55 from the bobbin of the winding package 10, then drop the winding package 10 into the inside of the spindle bucket 4.

As a preferred solution shown in FIG. 5, the carrier assembly 5 is structured in the relation that an articulating connection rod 57 has a suspending wheel set 56 suspending within in the in-air conveying rail 3, the articulating connection rod 57 is configured to articulate and connect a plurality of the conveying units with each other, the bottom of the articulating connection rod 57 is connected with a second carrier-connecting rod 59, the bottom of the second carrier-connecting rod 59 is connected with a hugging arm 58, a space for loading an inner yarn winding package 48 is arranged in the middle of the hugging arm 58, and an opening 503 is arranged at the bottom of the hugging arm 58.

As a preferred solution shown in FIGS. 1 and 2, a supporting frame 201 is arranged on the both sides of the twisting machine 1, the inner yarn-rail-lifting section 31 is slidingly connected with the supporting frame 201, a lifting device for inner yarn rails 2 is arranged on the supporting frame 201, the lifting device for inner yarn rails 2 is connected with the inner yarn-rail-lifting section 31, and configured to drive the inner yarn-rail-lifting section 31 to ascend and descend;

the lifting device for inner yarn rails 2 is an air cylinder, a hydraulic cylinder or a gear rack drive mechanism.

As a preferred solution shown in FIGS. 2 and 3, a supporting frame 201 is arranged on the both sides of the twisting machine 1, a lifting rail 211 is vertically arranged on a stick 214 of the supporting frame 211, a lifting pulley assembly 212 is arranged inside the lifting rail 211, and the lifting pulley assembly 212 is connected with the inner yarn-rail-lifting section 31 by means of a connecting rod 208;

the supporting frame 201 is provided with a plurality of rotary rotation shafts 202, which are arranged in the direction of the inner yarn-rail-lifting section 31, and the rotation shafts 202 are connected to a driving device 215 to drive the rotation shaft 202 to rotate, a plurality of winding disks 203 are arranged on the rotation shaft 202, each winding disk 203 is wound with a suspending belt 206, the lower end of the suspending belt 206 is connected to the inner yarn-rail-lifting section 31, and the rotation shaft 202 rotates to drive the inner yarn-rail-lifting section 31 to ascend and descend.

As a preferred solution shown in FIG. 3, the driving device 215 is the lifter driving motor 204, which is connected to the rotation shaft 202 by means of the transmission mechanism 205, and drives the rotation shaft 202 to rotate.

The lifter driving motor 204, the transmission mechanism 205 or the rotation shaft 202 is provided with a diversion angle sensor. The diversion angle sensor is used to detect the diversion angle of the rotation shaft 202 and thus to calculate the ascending and descending distance of the inner yarn-rail-lifting section 31.

As a preferred solution shown in FIGS. 2 and 3, the position sensor 213 is arranged at the position where the in-air conveying rail 3 is connected with the inner yarn-rail-lifting section 31, or at the position where the supporting frame 201 is slidingly connected with the inner yarn-rail-lifting section 31, so as to detect whether the inner yarn-rail-lifting section 31 is aligned with the in-air conveying rail 3. The position sensor 213 may be a limit switch, including a mechanical limit switch, a giant-magneto-resistance limit switch, a Hall switch, etc. Preferably, a dual control route is adopted in this example as a solution, where the inner yarn-rail-lifting section 31 ascends under the closed loop control of the position sensor 213, so that the inner yarn-rail-lifting section 31 is precisely aligned with the in-air conveying rail 3, and the inner yarn-rail-lifting section 31 descends under the open loop control of the diversion angle sensor 216.

As a preferred solution shown in FIG. 3, At the position where the in-air conveying rail 3 is connected with the inner yarn-rail-lifting section 31, the in-air conveying rail 3 has an upper baffle 209 arranged on the top of its end head, and side baffles 210 arranged on its both sides. The upper baffle 209 and the side baffles 210 are out from the end head of the in-air conveying rail 3, and the inside of the bottom of the side baffle 210 is provided with the bevel 217, which is fairly thin in the thickness near its bottom, and fairly thick in the thickness near its top. This structure can aid the inner yarn-rail-lifting section 31 in precisely aligning with the in-air conveying rail 3.

As a preferred solution shown in FIG. 2, the travel driving unit 9 is arranged on the in-air conveying rail 3 to drive the carrier assembly 5 to travel.

The in-air conveying rail 3 is provided with the carrier assembly sensor 8, which is used to detect the position of the carrier assembly and the sort of the winding packages 10 carried on the carrier assemblies 5. The carrier assembly sensor 8 includes a limit switch and a data reader, and the limit switch includes a mechanical limit switch, a giant-magneto-resistance limit switch, a Hall switch, etc. The data reader includes a camera, or an electronic tag reader, the 2D code or electronic tag corresponding to which is arranged on the carrier assembly 5, so as to record the ID code of the current carrier assembly 5, that is, bind the ID code to the parameters of the winding packages 10 at loading the winding packages 10 on carrier assembly 5.

The diverging-and-merging switch 6 is arranged on the in-air conveying rail 3, so as to switch different rails; and the diverging-and-merging switch 6 delivers the carrier assembly 5 to different positions according to the information of the winding packages 10 obtained by the carrier assembly sensor 8.

The sliding frames 11 are arranged at the bottoms of the both sides of the twisting machine 1, and the spindle bucket 4 is installed on the sliding frame 11, which is used to slide the spindle bucket 4 out from the twisting machine 1 for donning.

Example 2

In an example taken as an optimal solution for description, as shown in FIGS. 1~4, 6, during operation, the winding packages 10 are loaded on the carrier assembly 5, which is driven by the travel driving unit 9, and distributed to the inner yarn-rail-lifting sections 31 on both sides of the twisting machine 1 via the diverging-and-merging switch 6. Operators control the sliding frame 11 to slide out from the spindle position 101 of the twisting machine, and the sliding frame 11 may be manually controlled or automatically controlled.

Operators control the action of the lifter driving motor 204, which drives the rotation shaft 202 to rotate by means of the transmission mechanism 205. The transmission mechanism 205 in this example is a synchronous belt-driven mechanism, indeed as a reduction mechanism with reduction ratios of 1:3~5, and the descending operation is preferably under the open loop control without high precise requirements. The suspending belt 206 on the winding disk 203 is loosened, enabling the inner yarn-rail-lifting section 31 to descend. When the winding package 10 has descended into the spindle bucket 4, the four bar linkage 52 is pinched, so that the first suspending rod 54 and the second suspending rod 55 retract to loosen the winding package 10, which then falls into the spindle bucket 4, thus operators connect yarn on the ascending trolley 7. The lifter driving motor 204 rotates in reverse again, thus the winding disk 203 winds the suspending belt 206 around itself, and the inner yarn-rail-lifting section 31 ascends, and it is precisely aligned with the in-air conveying rail 3 along the side baffle 210, until the position sensor 213 detects the inner yarn-rail lifting section 31, then the lifter driving motor 204 stops actuation. The travel driving unit 9 acts, so as to drive the carrier assembly 5 to leave the inner yarn-rail lifting section 31, moving along the in-air conveying rail 3 to the donning position, where donning is made again. For ease to observe FIG. 1, there is only one travel driving unit 9 provided, with omission to provide the travel driving units 9 at other positions.

The above embodiments are only preferred technical solutions of the present disclosure, and should not be regarded as limiting the present disclosure. The embodiments in the present application and the features in the embodiments can be arbitrarily combined with each other without conflict. The scope of protection of the present disclosure shall be the technical solutions recorded in the claims, including the equivalent alternatives of the technical features in the technical solutions recorded in the claims. Equivalent substitutions and improvements in the scope are also included in the scope of protection of the present disclosure.

What is claimed is:

1. A lifting system for inner yarn rails, comprising an in-air conveying rail (3), said in-air conveying rail (3) being configured to convey a carrier assembly (5), and said carrier assembly (5) being configured to carry a winding package (10);

wherein an inner yarn-rail-lifting section (31) is arranged on said in-air conveying rail (3), the inner yarn-rail-lifting section (31) is positioned on both sides of a twisting machine (1); when the inner yarn-rail-lifting section (31) ascends, it communicates with said in-air conveying rail (3); when the inner yarn-rail-lifting section (31) descends, it approaches a position of a spindle bucket (4) of the twisting machine (1), wherein a supporting frame (201) is arranged on the both sides of the twisting machine (1), a lifting rail (211) is vertically arranged on a stick (214) of said supporting frame (201), a lifting pulley assembly (212) is arranged inside the lifting rail (211), and the lifting pulley assembly (212) is connected with the inner yarn-rail-lifting section (31) by means of a connecting rod (208);

the supporting frame (201) is provided with a plurality of rotary rotation shafts (202), which are arranged in a direction parallel to the inner yarn-rail-lifting section (31), and the rotation shafts (202) are connected to a driving device (215) to drive the rotation shaft (202) to rotate, a plurality of winding disks (203) are arranged on the rotation shaft (202), each winding disk (203) is wound with a suspending belt (206), the lower end of the suspending belt (206) is connected to the inner yarn-rail-lifting section (31), and the rotation shaft (202) rotates to drive the inner yarn-rail-lifting section (31) to ascend and descend, wherein at a position where said in-air conveying rail (3) is connected with the inner yarn-rail-lifting section (31), said in-air conveying rail (3) has an upper baffle (209) arranged on atop of its-end head, and side baffles (210) arranged on its both sides, the upper baffle (209) and the side baffle (210) are beyond the end head of said in-air conveying rail (3), and an inside of a bottom of the side baffle (210) is provided with a bevel (217), which is thinner in thickness at a bottom portion, and thicker in the thickness at a top portion.

2. The lifting system for inner yarn rails according to claim 1, wherein said carrier assembly (5) is composed of a plurality of conveying units articulated with each other, and each conveying unit in said carrier assembly (5) corresponds to a spindle position (101) of the twisting machine (1).

3. The lifting system for inner yarn rails according to claim 2, wherein said carrier assembly (5) is structured such that an articulating connection rod (57) has a suspending wheel set (56) suspended within said in-air conveying rail (3), the articulating connection rod (57) is configured to articulate and connect a plurality of the conveying units with each other, a bottom of the articulating connection rod (57) is connected with a first carrier-connecting rod (51), the first carrier-connecting rod (51) is connected with a four bar linkage (52), a draw spring (53) is arranged between two connecting rods (501,502) of the four bar linkage (52), the two connecting rods (501,502) of the four bar linkage (52) are connected with a first suspending rod (54) and a second suspending rod (55), respectively, and barbs are arranged on bottoms of the first suspending rod (54) and the second suspending rod (55);

the draw spring (53) is configured to direct the first suspending rod (54) and the second suspending rod (55) to part from each other.

4. The lifting system for inner yarn rails according to claim 2, wherein said carrier assembly (5) is structured such that an articulating connection rod (57) has a suspending wheel set (56) suspended within said in-air conveying rail (3), the articulating connection rod (57) is configured to articulate and connect a plurality of the conveying units with each other, the bottom of the articulating connection rod (57) is connected with a second carrier-connecting rod (59), the bottom of the second carrier-connecting rod (59) is connected with a hugging arm (58), a space for loading an inner yarn winding package (48) is arranged in the middle of the hugging arm (58), and an opening (503) is arranged at the bottom of the hugging arm (58).

5. The lifting system for inner yarn rails according to claim 1, wherein a supporting frame (201) is arranged on the both sides of the twisting machine (1), the inner yarn-rail-lifting section (31) is slidingly connected with the supporting frame (201), a lifting device for inner yarn rails (2) is arranged on the supporting frame (201); the lifting device for inner yarn rails (2) is connected with the inner yarn-rail-lifting section (31), and configured to drive the inner yarn-rail-lifting section (31) to ascend and descend; the lifting device for inner yarn rails (2) is an air cylinder, a hydraulic cylinder or a gear rack drive mechanism.

6. The lifting system for inner yarn rails according to claim 1, wherein the driving device (215) is a lifter driving motor (204), the lifter driving motor (204) is connected to the rotation shaft (202) by means of a transmission mechanism (205), and drives the rotation shaft (202) to rotate;

the lifter driving motor (204), the transmission mechanism (205) or the rotation shaft (202) is provided with a diversion angle sensor (216).

7. The lifting system for inner yarn rails according to claim 6, wherein a position sensor (213) located at a junction position where said in-air conveying rail (3) is connected with the inner yarn-rail-lifting section (31), or at a junction position where the supporting frame (201) is connected with the inner yarn-rail-lifting section (31), so as to detect whether the inner yarn-rail-lifting section (31) is aligned with said in-air conveying rail (3).

8. The lifting system for inner yarn rails according to claim 1, wherein a travel driving unit (9) is arranged on said in-air conveying rail (3) to drive said carrier assembly (5) to travel;

said in-air conveying rail (3) is provided with a carrier assembly sensor (8), which is configured to detect the position of said carrier assembly (5) and the sort of the winding packages (10) carried on said carrier assembly (5);

a diverging-and-merging switch (6) is arranged on said in-air conveying rail (3), so as to switch different rails;

a sliding frame (11) is arranged at the bottoms of the both sides of the twisting machine (1), and the spindle bucket (4) is arranged on the sliding frame (11).

* * * * *